US005586475A

United States Patent [19]

Wenner

[11] Patent Number: 5,586,475

[45] Date of Patent: Dec. 24, 1996

[54] RACHETING TYPE TOOL HAVING FREE WHEELING SLEEVE TO FACILITATE USE

[76] Inventor: Jeffrey W. Wenner, 520 Singley Ave., Runnemede, N.J. 08078

[21] Appl. No.: 385,108

[22] Filed: Feb. 7, 1995

[51] Int. Cl.[6] ..... B25B 13/46; B25B 23/16

[52] U.S. Cl. ..... 81/60; 81/184; 81/177.2

[58] Field of Search ..... 81/177.2, 177.3, 81/177.5, 177.85, 489, 60, 63.1, 30, 31, 32, 33, 438, 177.1, 58, 59.1, 61, 62, 63, 63.2, 29, 35, 180.1, 184

[56] References Cited

U.S. PATENT DOCUMENTS

| | | | |
|---|---|---|---|
| 2,734,413 | 2/1956 | Dunkelberger | 81/63.2 |
| 3,343,434 | 9/1967 | Schroeder | 81/29 |
| 4,102,375 | 7/1978 | Rossini | 81/30 |
| 4,856,388 | 8/1989 | Freeman | 81/177.2 |
| 5,020,397 | 6/1991 | Minuto | 81/177.2 |

FOREIGN PATENT DOCUMENTS

| | | | |
|---|---|---|---|
| 2339320 | 8/1977 | France | 81/177.1 |

*Primary Examiner*—Bruce M. Kisliuk
*Assistant Examiner*—Joni B. Danganan
*Attorney, Agent, or Firm*—Louis Weinstein

[57] ABSTRACT

A rachet-type hand tool having a sleeve-like guide free-wheelingly mounted about a main body portion of the tool. A main shaft is rotatably mounted within the interior of the main body. An upper end of the shaft is secured to a three-way rachet mechanism. An operating rod/socket coupler releasably couples tool implements such as screwdriver heads, hex heads and the like to the operating rod. A torque extension handle is releasably mounted to the upper end of the main body and is provided with short and long lever arms selectable for gripping by the user to obtain the desired torque. Finger holes are provided in the torque extension handle for rapid rotation of the tool for insertion or removal of a screw, bolt or the like when only very light friction is encountered. An opposite arm of the torque extension handle is easily removed and can be replaced by another torque extension arm. The freely rotatable guide sleeve facilitates positioning, holding and guiding of the tool while either low speed or high speed torque is applied.

6 Claims, 5 Drawing Sheets

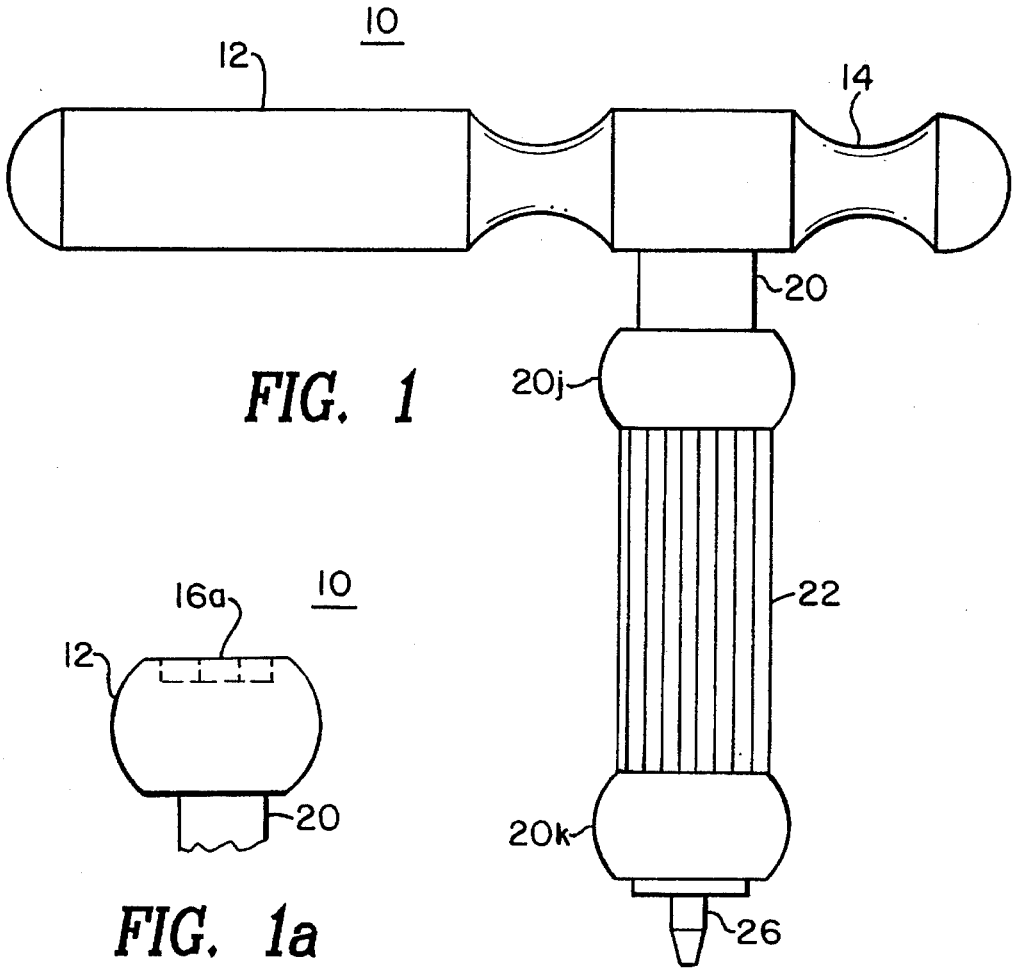
FIG. 1
FIG. 1a
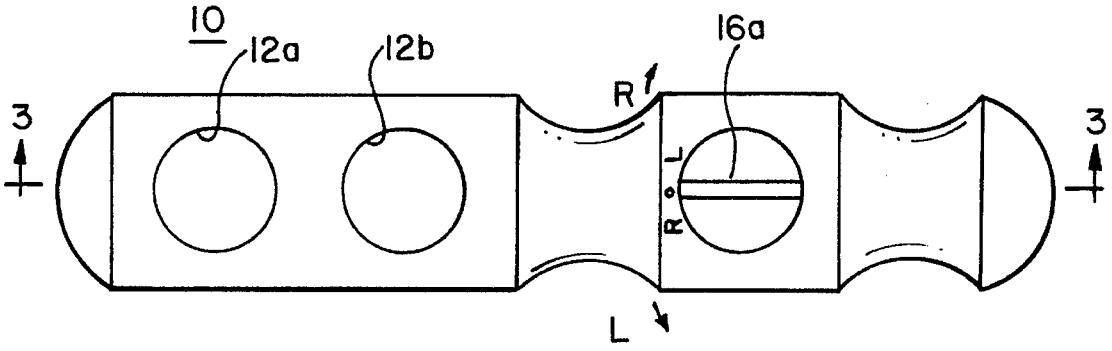
FIG. 1b

RACHETING TYPE TOOL HAVING FREE WHEELING SLEEVE TO FACILITATE USE

FIELD OF THE INVENTION

The present invention relates to rachet-type hand tools and more particularly to a rachet-type hand tool having a freely rotatable guiding sleeve and a handle for loosening/tightening and torquing which is preferably provided with a releasably mounted portion.

BACKGROUND OF THE INVENTION

Hand tools are typically utilized for a variety of applications among which include the loosening/removing and mounting/tightening of threaded members such as screws, bolts and the like. As one example, battery-powered hand tools are utilized for such applications. However, although battery powered hand tools are advantageous for high speed rotation of threaded members, in applications where the holding friction between engaging surfaces of the threaded portions is great, due to oxidation, rust or other causes, quite often there is insufficient energy to overcome these frictional forces. Likewise, in applications where a threaded member is rotated at high speed up to the point where fastening occurs, such battery-powered tools often have insufficient power to obtain the desired torque or leverage to tighten the threaded member by a desired amount.

On the other hand, conventional hand tools such as the conventional screwdriver of the straight-head, phillips-head or hex-head type are difficult to manipulate in order to perform high speed rotation and have the further limitation of being limited to the torque capable of being applied merely through the use of operator's fingers since they typically lack a leveraging member.

It thus becomes extremely advantageous to provide a hand tool which is simple in design, easy to use and which overcomes the disadvantages of both battery-powered and manual hand tools of the type described hereinabove.

BRIEF DESCRIPTION OF THE INVENTION

The present invention provides a hand operated tool which overcomes the aforementioned disadvantages of conventional hand tools of both the manual and battery operated type and which is characterized by comprising a body drive shaft rotatably mounted within a hollow interior thereof and selectively coupled preferably with a three-way racheting mechanism provided at an upper end of the tool body and is capable of being selectively racheted in either of two opposing directions or alternatively being locked against racheting.

A lower end of the tool body is open to permit a tip to be releasably mounted to the lower end of the operating shaft. A substantially cylindrical-shaped sleeve surrounds and is freely rotatable about the tool body for gripping and guiding purposes.

A leverage/torquing handle is arranged at the upper end of the tool body and is provided with spaced openings therealong for torquing purposes. The leverage/torquing arm has a short arm portion preferably detachably mounted thereto and cooperating with the long arm portion for tightening or loosening operations requiring the use of both of the operator's hands. When it is desired to rapidly rotate a threaded member, an operator may hold the guide sleeve with one hand to align the tool and selects one of the finger holes to permit rapid rotation, i.e. high speed "torquing" of the tool.

A variety of tips may be mounted upon the operating shaft according to the threaded member to be respectively tightened or loosened. The short arm portion may be removed for those applications where there is insufficient clearance for the short arm portion.

In an alternative embodiment, the main body portion is detachably mounted to the torquing handle/ratchet assembly which is provided with a coupler to receive tool tips in applications where a shorter tool length is required.

OBJECTS OF THE INVENTION

It is therefore one object of the present invention to provide a hand tool having a rotatable sleeve for aligning and guiding the hand tool and to facilitate torquing of a hand tool lever arm.

Still another object of the present invention is to provide a hand tool having a lever arm provided with a plurality of finger holes to facilitate torquing operations.

Still another object of the present invention is to provide a hand tool of the character described and having a racheting mechanism to facilitate a torquing operation.

Still another object of the invention is to provide a hand tool with a detachable main body portion for applications requiring a hand tool of reduced length.

The above as well as other object of the present invention will become apparent when reading the accompanying description and drawings in which:

BRIEF DESCRIPTION OF THE FIGURES

FIG. 1 shows an elevational view of a hand tool embodying the principles of the present invention;

FIG. 1*a* shows an end view of the torquing handle employed in the hand tool of FIG. 1;

FIG. 1*b* is a top view of the hand tool shown in FIG. 1;

DETAILED DESCRIPTION OF THE INVENTION AND PREFERRED EMBODIMENTS THEREOF

Figures 2, 2A, 2B:
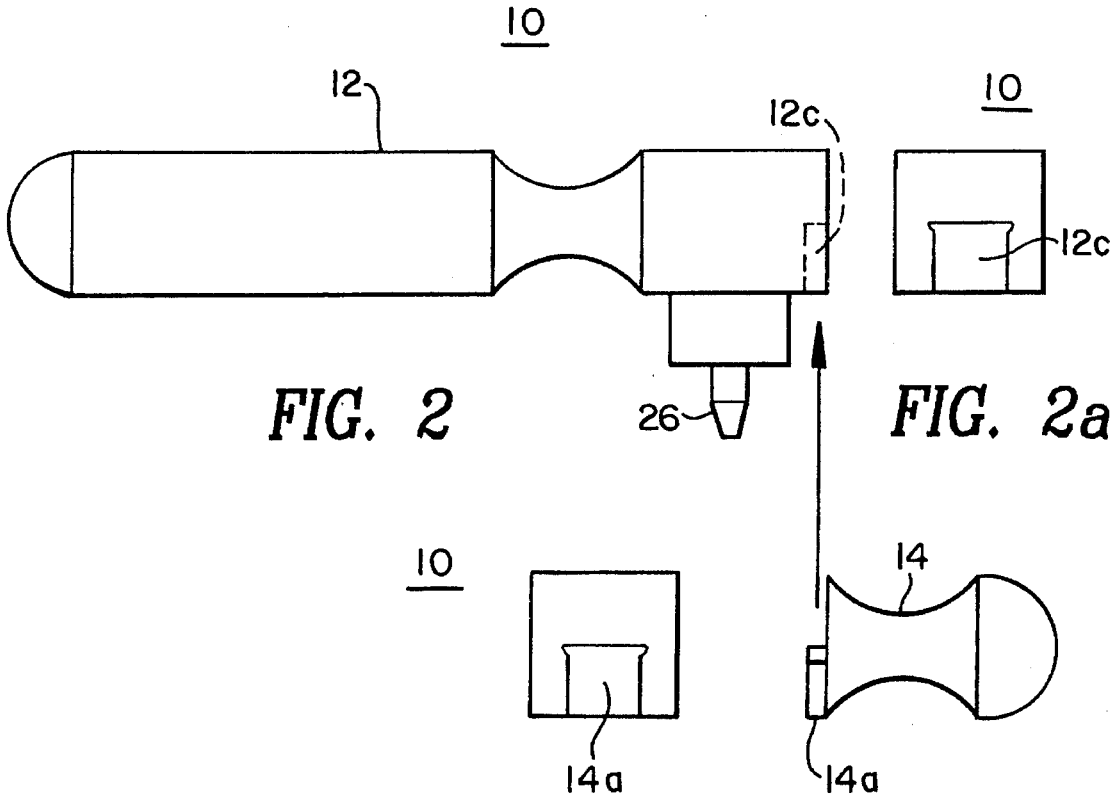
FIG. 2 is an exploded side view of the torquing handle with the two handle portions being separated.
FIG. 2*a* is an end view of the right-hand end of the longer handle portion of FIG. 2.
FIG. 2*b* is an end view of the left-hand end of the short handle portion of FIG. 2.
Figure 3:
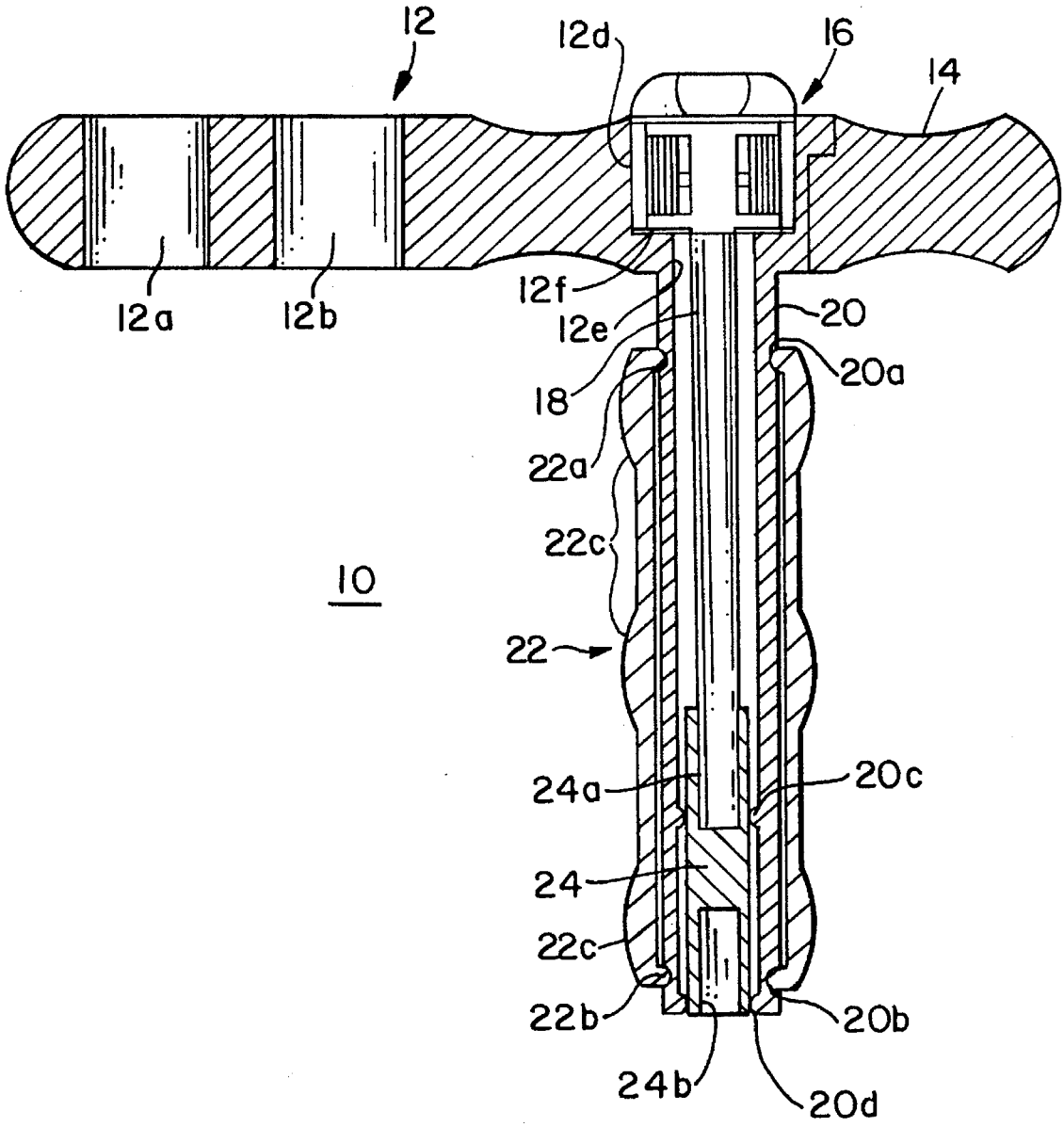
FIG. 3 is a sectional view of the hand tool looking in the direction of arrows 3—3 of FIG. 1*b;*

FIGS. 1 through 3 show a hand tool 10 comprised of a main handle portion 12 having openings 12*a* and 12*b*. A short handle portion 14 is releasably attached to main handle portion 12 in a manner to be more fully described. More specifically, as shown in FIGS. 2, 2*a*, 2*b*, the right-hand end of main handle portion 12 is provided with a female coupling portion in the form of a dove-tail recess 12*c*. The left-hand end of short handle portion 14 is provided with a male projection 14*a* of a shape conforming to recess 12*c* and which is slidably received within and locked within the female recess 12*c* by: aligning small handle portion 14 in the manner shown in FIG. 2; and moving the handle portion 14 upwardly in the direction of the arrow so that projection 14*a* slides into recess 12*c* and is snap-fitted thereto when the detachable torque extension 14 is moved to the fully assembled position shown in FIG. 1. A plurality of handle extensions 14 of different length may be provided, if desired.

Main handle portion 12 is provided with a cylindrical-shaped bore 12*d* of a first diameter which reduces to a cylindrical-shaped bore 12*e* of a second, smaller diameter which merges with bore 12*d* at a shoulder 12*f*. A conventional racheting mechanism 16 is housed within the interior of bore 12*d* and is provided with an operating member 16*a* which may be manipulated by the operator's fingers so as to align operating member 16*a* with one of the operating positions "O", "L" and "R" which respectively provide no racheting; a driving force when the handle is moved to the left or counterclockwise as shown by arrow L in FIG. 1*b* while racheting in the opposite direction; and a driving force in a clockwise direction as shown by arrow R while racheting in the opposite direction. The ratcheting mechanism may be of any suitable type such as is described in U.S. Pat. No. 2,891,434. Any other conventional ratcheting mechanism may be employed if desired. The operating member is recessed within an opening in the handle portion 12 so that its top surface is substantially flush with the top surface of the handle portion surrounding said opening.

The lower end of the racheting mechanism is integrally joined to the upper end of elongated operating rod 18. The lower end of the main handle portion 12 is integrally joined to the upper end of a cylindrical-shaped main body 20 which is hollow over substantially its entire length, defining a continuation of smaller diameter bore 12*e*.

Both the interior and exterior peripheries of main body 20 are substantially cylindrical in shape. The exterior periphery, in the embodiment of FIG. 3, is provided with a pair of continuous grooves 20*a*, 20*b* extending about the outer periphery at spaced intervals, groove 20*a* being close to racheting mechanism 16 and groove 20*b* being close to the lower end of main body 20. An elongated guide collar 22 is snap-fitted on to the main body 20 so as to be freewheelingly mounted thereon. Guide collar or sleeve 22 is a substantially cylindrical-shaped hollow member having first and second inwardly directed projections 22*a*, 22*b* each having a substantially semicircular shape and adapted to be snap-fitted into a respective one of the grooves 20*a*, 20*b* which retain the guide sleeve 22 on main body 20 while enabling the guide sleeve to be freely rotated relative to main body 20. The grooves in main body 20 and the projections on sleeve 22 may be reversed while providing substantially the same objectives obtained through the embodiment of FIG. 3.

A coupler 24 has a cylindrical-shaped bore 24*a* at its upper end for receiving the lower end of operating rod 18 which is preferably press-fitted therein.

Figure 4:
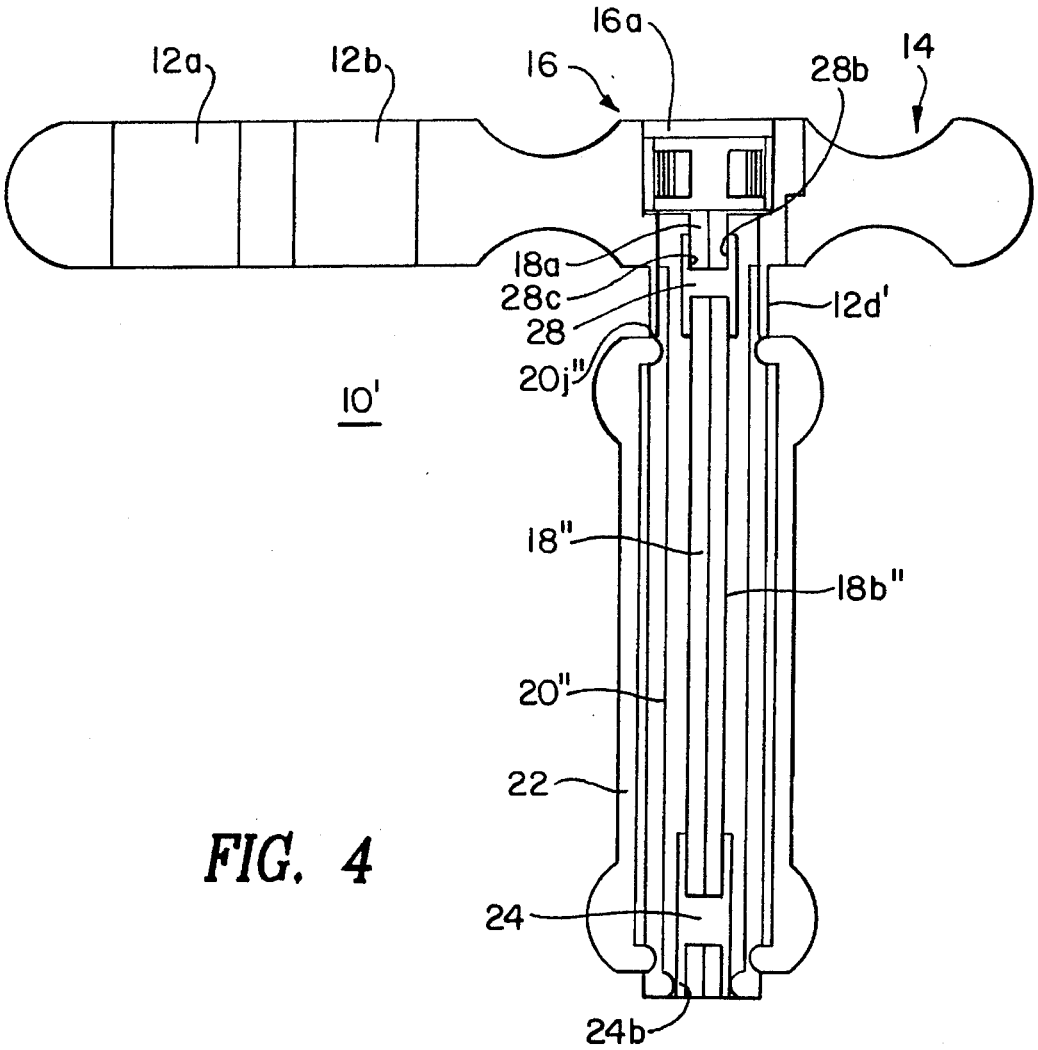
FIG. 4 is a sectional view of another embodiment of the present invention similar to the sectional view shown in FIG. 3.

Coupler 24 has a cylindrical-shaped outer periphery and is rotatably guided within main body 20 and is maintained in proper alignment therein by means of a pair of continuous, spaced-apart projections 20*c*, 20*d* each having a substantially semicircular-shaped surface and providing minimal sliding engagement with the outer periphery of coupler 24 to minimize friction therebetween. In an effort to reduce sliding friction between members 18 and 20, only two cooperating projections/grooves are provided. If desired, one or more cooperating projections/grooves may be provided intermediate the projections 22*a*, 22*b* and cooperating grooves 20*a*, 20*b*. In a similar manner and for a similar objective the projections 20*c* may be omitted, as shown in FIG. 4.

The lower end of coupler 24 is provided with a hollow bore at its lower end which preferably has a non-circular cross-sectional shape such as a square, hexagonal or octagonal shape, for example, and which is adapted to receive the upper or mounting end of a tool tip 26, which upper end has a cross-sectional shape conforming to the cross-sectional shaped opening 24*b* of coupler 24 to detachably mount the tool tip. The tool tip may assume a variety of configurations such as a conventional, thin wedge-shaped tip inserted into a slot in the head of a screw for mounting and demounting such conventional screws, bolts and the like, a hex head for mounting and demounting screws and bolts having a hex head, a phillips head for mounting and demounting screws, bolts and the like having a phillips type head, and so forth. In addition, the tool tips may be of varying size, diameter and the like to accommodate screws, bolts, nuts and the like having heads whose diameters vary over a broad range.

Sleeve 22 is provided with arcuate-shaped projections 22*c* about its outer periphery to facilitate gripping. As an alternative arrangement the outer periphery of sleeve 22 may be provided with shallow, elongated grooves which extend substantially parallel to the longitudinal axis of sleeve 22 as another alternative manner for facilitating gripping of the sleeve. As another alternative, the arcuate projections may be supplemented with one or more like projections arranged intermediate the projections 20*j*, 20*k*.

The hand tool 10 may be operated in the following manner:

Based on the application, the appropriate tool tip is inserted within coupler 24. Assuming that the operation to be performed is the removal a screw, bolt or nut from a mating member, the tool, after mounting of the proper tool tip and setting the rachet-mechanism to the proper position, is guided into position by holding sleeve 22 to align the tool tip with the member to receive or be received thereby. Once the tool tip is aligned, the handle portions 12 and 14 are gripped to apply the necessary force to loosen the member being removed. Assuming that the holding friction between the threaded member being removed and the member with which it mates is great, the arm portions are of a length to provide leverage to create a force sufficient to overcome such friction.

Once the threaded member being removed is sufficiently loosened and no longer requires the exertion of a large force and it is now desired to rapidly remove the threaded member, sleeve 22 is gripped by one hand while the operator inserts a finger of the remaining hand into one of the openings 12*a* or 12*b* to rapidly spin the tool about the longitudinal axis of operating rod 18. Obviously, if desired, a smaller or larger number of openings may be provided along the length of torquing handle 12.

Even though the guide sleeve 12 is gripped by one of the operator's hands, the friction between the guide sleeve 12 and main body 20 is minimal, enabling high speed rotation of the torquing handle 12 and hence the tool tip 26, for driving the threaded member.

A mounting of a threaded member is performed by substantially reversing the steps set forth hereinabove which includes setting the ratchet mechanism operating member to the proper position; selecting and mounting the proper tool tip; aligning the tool tip with the threaded member and rotating the torquing handle 12 at high speed while guiding the hand tool by gripping guide sleeve 12.

A high speed torquing operation is continued until the threaded member experiences increased friction at which time the handle portion 12 or handle portions 12 and 14 may be gripped to provide the desired tightening force.

In applications where it is not possible to rotate the torquing handle 12 through one or more 360° turns, the torquing handle 12 may nevertheless be operated at high speed by rotating the handle back and forth (through an angle of less than 360°) about the longitudinal axis of operating rod 18 through the use of one hand (or one finger) engaging torquing handle 12 while the other hand holds rotatable guide sleeve 22. This back and forth torquing operation may be performed with equal ease for both insertion and removal of threaded members.

FIG. 4 shows another alternative embodiment 10' of the present invention, wherein like elements designate like numerals as between embodiments 10 and 10' and only those elements which differ from the previous embodiments will be described. These elements are designated by primed numbers (except for element 28 which does not appear in embodiment 10).

The lower end of handle 12, in contrast to the embodiments shown in FIG. 3, terminates in a short, hollow cylindrical portion **12*d'*. The shaft 18" in the embodiment of FIG. 4 is divided into short shaft portion 18*a"* and long shaft portion 18*b"*. Short shaft portion 18*a"* has its upper end integrally joined to the lower end of the racheting mechanism 16 in a manner similar to the embodiment of FIG. 3. In contrast to the embodiment of FIG. 3, the lower end of short operating rod 18*a"* is inserted into an upper bore 28*a* of a second coupler 28** and is preferably press-fitted thereto.

The upper end of elongated operating rod portion **18*b"* is detachably inserted within a lower bore 28*b* in coupler 28. Lower bore 28*b*, in a manner similar to the lower bore 24*b* of coupler 24, has a polygonal-shaped (or other appropriate shape) cross-section and the upper end of elongated operating rod 18*b"* has a conforming cross-sectional shape which is the same as that provided at the upper, mounting ends of the tool tips, such as tool tip 26, insertable into the lower end 24*b* of coupler 24**, as was described hereinabove.

The main body portion 20' has an outer peripheral portion **20*h'* of reduced diameter which terminates at its inward end in shoulder 20*i'*. This portion 20*h'* is of reduced wall thickness as compared with the wall thickness of the remaining portion of main body 20'**.

The alternative arrangements of the embodiment 10' will now be described.

As shown in FIG. **4*a*, the reduced thickness upper end 20*h'* of main body 20' is force-fitted into the hollow annular region between the outer periphery of coupler 28 and the inner periphery of the short, hollow cylindrical-shaped section 12*d'*. Simultaneously therewith, the upper "keyed" end of operating rod 18*b"* is inserted into the lower bore 28*b* of coupler 28. The two components of the hand tool are properly assembled when the shoulder 20*i"* of main body 20" abuts against the lower end of cylindrical-shaped projection 12*d'*, as shown in FIG. 4. At this time the top of operating rod 18" preferably engages the base 28*c* of bore 28*b*. The tool, when assembled in the manner shown in FIG. 4, operates in substantially the same manner as tool 10 shown in FIG. 3**.

Figure 5:
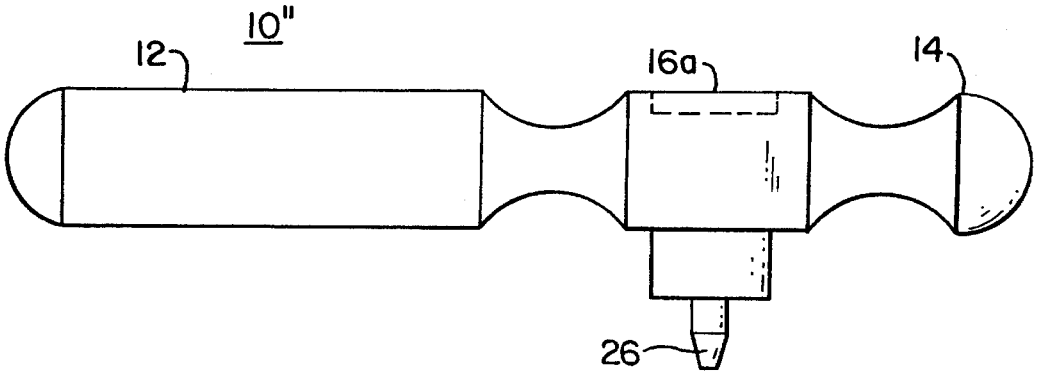
FIG. 5 is a side view of the alternative hand tool embodiment of FIG. 4 with the lower body portion being detached therefrom.
Figure 4A:
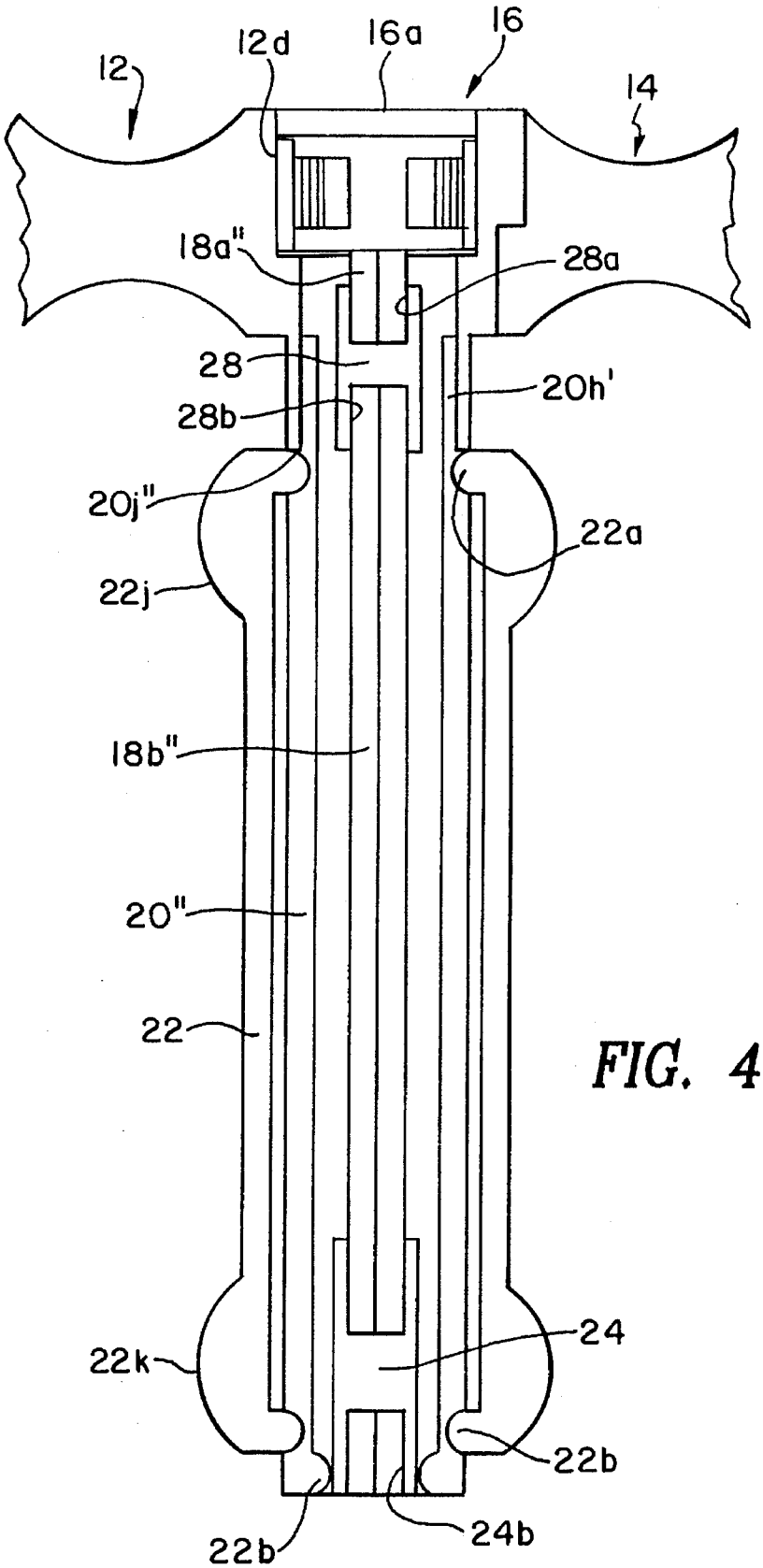
FIG. 4*a* is an enlarged view of FIG. 4.

In applications where a tool of shorter length is required, main body 20' may be detached from cylindrical-shaped projection **12*d'* to provide a hand tool of significantly reduced axial length, as shown in FIGS. 2 and 5. Cylindrical projection 12*d'* and main body 20' may alternatively be considered as a main body which is separated into two parts which are detachable to achieve the objectives of embodiment 10'**.

The lower bore **28*b* in coupler 28 is preferably designed to be of the same shape and configuration as the lower bore 24*b* of coupler 24, enabling the coupler 28 to receive the same type of tool tips, such as tool tip 26, that may be detachably mounted within coupler 24. FIGS. 2 and 5 show a tool tip 26 mounted within coupler 28**.

The embodiment of FIG. 4 provides a hand tool with significantly increased versatility allowing the hand tool to be utilized in applications where the space for manipulating the hand tool and especially the overhead space is severely limited.

The short handle portion 14 in the embodiment 10' of FIG. 4 (and FIG. 2) may be removed in the same manner as was described hereinabove in connection with the embodiment 10 shown in FIG. 3 in applications where operating room is still further limited.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Hand tool comprising:

an annular-shaped hollow main body;

an elongated torquing handle integral with said main body having a hollow interior portion and extending substantially at right angles to a longitudinal axis of said hollow main body;

adjustable ratcheting means arranged within a cavity in said main body adjacent to said torquing handle;

an operating rod extending along the hollow interior of said main body and having an upper end joined to said ratcheting means;

means in said main body for permitting substantially free rotation of said operating rod relative to said main body while maintaining a longitudinal axis of said operating rod substantially coaxial with a longitudinal axis of said main body;

said main body having an open end remote from said torquing handle;

coupler means for releasably coupling tool tips to a lower end of said operating rod, said tool tips extending through said open end;

an elongated, cylindrical-shaped guide sleeve being rotatably mounted about an outer periphery of said main body; and said main body including means for rotatably mounting said sleeve to said main body while preventing movement of said sleeve in a direction of said longitudinal axis, enabling said hand tool to be rotated by said torquing handle while said guide sleeve is gripped by an operator's hand to maintain the hand tool in alignment with a member to be rotatably driven by the hand tool;

said main body is divided into a first body portion having a first axial length and a second body portion having a second axial length greater than said first axial length releasably detachable to said first body portion;

said operating rod being divided into a first operating rod portion having a first axial length and a second operating rod portion of a second axial length greater than the axial length of said first operating rod portion;

said first operating rod portion being coupled to said ratcheting means; and second coupler means for releasably coupling said first operating rod portion to said elongated operating rod portion.

2. A hand tool according to claim 1 wherein said second body portion has a first end of reduced thickness for insertion into a hollow annular region between an inner periphery of said first body portion and an outer periphery of said second coupler means.

3. A hand tool according to claim 1 wherein said second coupler means includes means for selectively coupling thereto one of the elongated operating rod portion and a tool tip thereby enabling the hand tool to be used with the lower main body portion either mounted thereto or detached therefrom.

4. A hand tool according to claim 1 wherein said coupler means comprises a coupler member having a first end joined to said short operating rod and having a second end provided with a non-circular opening for detachably receiving either one end of said elongated operating rod portion having a cross-sectional shape conforming to the cross-sectional shape of the non-circular opening in said second coupler means or a mounting end of a tool tip having a cross-sectional shape conforming to the cross-sectional shape of the non-circular opening in said second coupler means.

5. Hand tool comprising:

an annular-shaped hollow main body;

an elongated torquing handle integral with said main body having a hollow interior portion and extending substantially at right angles to a longitudinal axis of said hollow main body;

adjustable ratcheting means arranged within a cavity in said main body adjacent to said torquing handle;

an operating rod extending along the hollow interior of said main body and having an upper end joined to said ratcheting means;

means in said main body for permitting substantially free rotation of said operating rod relative to said main body while maintaining a longitudinal axis of said operating rod substantially coaxial with a longitudinal axis of said main body;

said main body having an open end remote from said torquing handle;

coupler means for releasably coupling tool tips to a lower end of said operating rod, said tool tips extending through said open end;

an elongated, cylindrical-shaped guide sleeve being rotatably mounted about an outer periphery of said main body; and said main body including means for rotatably mounting said sleeve to said main body while preventing movement of said sleeve in a direction of said longitudinal axis, enabling said hand tool to be rotated by said torquing handle while said guide sleeve is gripped by an operator's hand to maintain the hand tool in alignment with a member to be rotatably driven by the hand tool;

said means for rotatably mounting said guide sleeve to said main body comprising a plurality of annular projections arranged at spaced intervals about an interior periphery of said guide sleeve and a plurality of annular recesses provided about an outer periphery of said main body and conforming in shape to the projections provided on said guide sleeve, each of said projections being seated in and slidably engaging an associated one of said recesses.

6. Hand tool comprising:

an annular-shaped hollow main body;

an elongated torquing handle integral with said main body having a hollow interior portion and extending substantially at right angles to a longitudinal axis of said hollow main body;

adjustable ratcheting means arranged within a cavity in said main body adjacent to said torquing handle;

an operating rod extending along the hollow interior of said main body and having an upper end joined to said ratcheting means;

means in said main body for permitting substantially free rotation of said operating rod relative to said main body while maintaining a longitudinal axis of said operating rod substantially coaxial with a longitudinal axis of said main body;

said main body having an open end remote from said torquing handle;

coupler means for releasably coupling tool tips to a lower end of said operating rod, said tool tips extending through said open end;

an elongated, cylindrical-shaped guide sleeve being rotatably mounted about an outer periphery of said main body; and said main body including means for rotatably mounting said sleeve to said main body while preventing movement of said sleeve in a direction of said longitudinal axis, enabling said hand tool to be rotated by said torquing handle while said guide sleeve is gripped by an operator's hand to maintain the hand tool in alignment with a member to be rotatably driven by the hand tool;

said means for rotatably mounting said guide sleeve to said main body comprising a plurality of annular grooves arranged at spaced intervals about an interior periphery of said guide sleeve and a plurality of annular projections provided about an outer periphery of said main body and conforming in shape to the grooves provided on said guide sleeve, each of said projections being seated in and slidably engaging an associated one of said grooves.

* * * * *